US006565392B2

(12) United States Patent
Padro

(10) Patent No.: US 6,565,392 B2
(45) Date of Patent: May 20, 2003

(54) COMPLIANT SECTION FOR AN ELECTRICAL CONTACT

(75) Inventor: Kenny Padro, New Haven, CT (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 09/965,869

(22) Filed: Oct. 1, 2001

(65) Prior Publication Data

US 2003/0064632 A1 Apr. 3, 2003

(51) Int. Cl.[7] ..... H01R 13/42

(52) U.S. Cl. ..... 439/751; 439/78; 439/943; 439/82

(58) Field of Search ..... 439/751, 443, 439/66, 78, 493, 82, 81; 436/84

(56) References Cited

U.S. PATENT DOCUMENTS 4,446,505 A * 5/1984 Long et al. ..... 361/785
5,129,830 A * 7/1992 Krajewski et al. ..... 439/75
6,050,842 A * 4/2000 Ferrill et al. ..... 439/404

OTHER PUBLICATIONS

Catalog "Winchester MetCon–2® 2mm Hard Metric Connector", Jul. 2001, pp. 1–50.

* cited by examiner

*Primary Examiner*—Tho D. Ta
*Assistant Examiner*—James R. Harvey
(74) *Attorney, Agent, or Firm*—Lowe Hauptman Gilman & Berner, LLP

(57) ABSTRACT

The present invention is directed to an electrical contact having a compliant section. The electrical contact has a primary section retained within an electrical contact. The electrical contact has a secondary section that includes an elongated section and a compliant section. The compliant section is formed such that when the compliant section is inserted into a hole in a PC board, the compliant section and the elongated section remain straight within a wide range of manufacturing tolerances.

19 Claims, 2 Drawing Sheets

COMPLIANT SECTION FOR AN ELECTRICAL CONTACT

FIELD OF THE INVENTION

The present invention relates generally to the field of electrical connectors, and more particularly, to an electrical contact for an electrical connector. More particularly, the present invention relates to an electrical contact having a compliant section for insertion into a PC board.

BACKGROUND OF THE INVENTION

Modern electronic systems continue to demand higher density, higher speed and more cost-effective packaging in interconnection solutions. For example, Winchester Electronics markets a series of connectors called MetCon-2® 2mm hard metric connector systems. These types of connectors have multiple contacts sometimes arranged in 5×5 matrices which are tightly spaced together. These types of connectors are described in greater detail in a catalog entitled "Winchester MetCon-2® 2mm Hard Metric Connector", incorporated herein by reference.

As depicted in FIG. 1A a prior art contact 10 is depicted. The contact 10 includes a primary portion 12 which is inserted into one-half of an electrical connector (see FIG. 3). The primary portion 12 is retained within the electrical connector in a conventional manner and a secondary portion 14 extends outwardly beyond the electrical connector for insertion into corresponding holes in a PC board. The secondary portion 14 includes a compliant portion 16 and an elongated pin portion 18. The compliant portion 16 has opposed rounded outer surfaces 20 and a cat's eye shaped central opening 22. The difficulty with the prior art compliant portion 16 is illustrated in FIG. 1B.

In FIG. 1B, the compliant section 16 is inserted into a plated through hole 28 illustrated in FIG. 2. When each contact 10 is inserted into a through hole 28, there is a tendency for some or all of the elongated sections 14 to tip at an angle as illustrated in FIG. 1B. Because of the length of each of the compliant sections and because of the tight spacing between these contacts, it is very important that the secondary side of the contacts remain straight without tipping in order to be inserted into a mating connector. This problem is exacerbated by the fact that these contacts are closely spaced and, for example, a matrix of 5×5 array, there is a high likelihood of stubbing one or more of the contacts when an electrical connector is mated to the elongated sections 14. When an elongated section 14 is stubbed, the pin 14 is crushed and of course no signal can be carried by the pin.

The cause of the tipping is due to the compliant section 20. If the cat's eye opening 22 is slightly off center due to manufacturing tolerances by as little as 0.005 inches, then unequal forces are created on the compliant section 22 as illustrated in FIG. 1B when the each contact is pressed into a through hole 28. When the compliant section 22 is inserted into the hole 28, the purpose of the compliant section 22 is to maintain a holding force. Referring to FIG. 1B, there are two curved beam sections 24, 26 on opposing sides of compliant section 22. If one of the two beams is slightly thinner than the other beam then it is likely that tipping will occur.

Accordingly, a need exists for a compliant section of a contact which can be inserted into a round hole which will stay straight and not tip within a wide zone of manufacturing tolerances.

SUMMARY OF THE INVENTION

It is therefore, an object of the present invention to provide an electrical contact having a compliant section which will not tip significantly when inserted into a hole in a PC board within a wide range of manufacturing tolerances.

The present invention is directed to an electrical contact having a compliant section. The electrical contact has a primary section retained within an electrical contact. The electrical contact has a secondary section that includes an elongated section and a compliant section. The compliant section is formed such that when the compliant section is inserted into a hole in a PC board, the compliant section and the elongated section remain straight within a manufacturable range of manufacturing tolerances.

These and other objects of the present invention are achieved by a contact for insertion into a hole in a PC board. The contact has a contact body including an engagement portion for engagement with an electrical connector body. The contact body has an elongated section and a compliant section connecting the engagement portion and the elongated section. The compliant section has a plurality of holes formed therethrough thereby forming at least one bridge section. Each bridge section is located between two adjacent ones of the holes.

The foregoing and other objects of the present invention is achieved by a contact for insertion into a hole in a PC board. The contact body includes an engagement portion for engagement with an electrical connector body. The contact body has an elongated section and a compliant section connecting the engagement portion and the elongated section. The compliant section has a plurality of holes formed therethrough thereby forming at least one bridge section. Each bridge section is located between two adjacent ones of the holes. The plurality of holes comprises three holes joined coaxially along a centerline of the contact body. The compliant section has opposed rounded surfaces symmetric about a center one of the three hole, wherein the rounded outer surfaces are convex relative to the plurality of holes.

The foregoing and other objects of the present invention are achieved by an electrical connector having a plurality of contacts each for insertion into a corresponding hole in a PC board. The contact includes a connector body and a plurality of contacts. The connector body has a plurality of locations for receiving a corresponding contact. Each contact includes a contact body including an engagement portion for engagement with an electrical connector body. The contact body has an elongated section and a compliant section connecting the engagement portion and the elongated section. The compliant section has a plurality of holes formed therethrough thereby forming at least one bridge section. Each bridge section is located between two adjacent ones of the holes.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF THE INVENTION

Figure 4B:
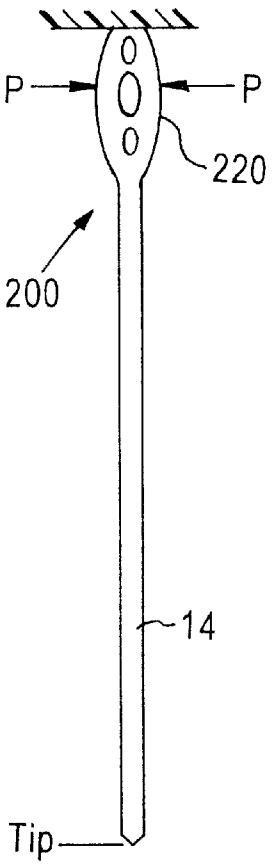
FIG. 4B is an illustration illustrating the elongation of the holes in the compliant section of the electrical contact according to the present invention.
Figure 4A:
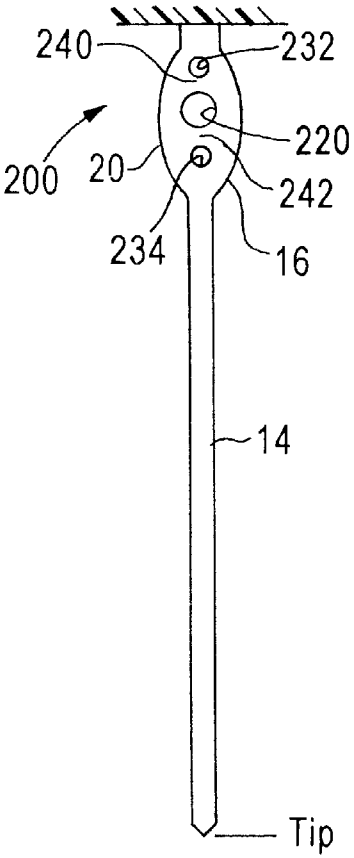
FIG. 4A is an illustration of the secondary section of an electrical contact according to the present invention.

Referring first to FIG. 4A, the present invention is directed to the compliant section of an electrical contact 200. The present invention is particularly advantageous when used with an elongated contact section.

Figure 1B:
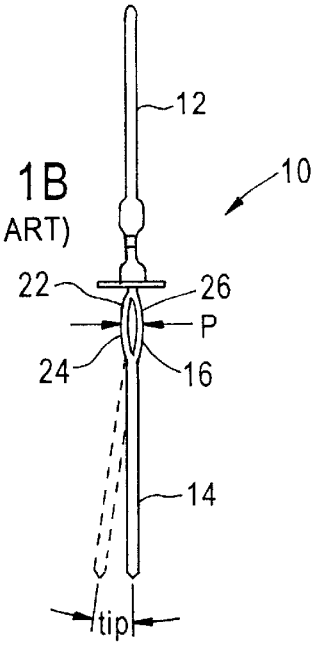
FIG. 1B (PRIOR ART)
FIG. 1B is an illustration of a prior art contact with the elongated section having tipped after being inserted into a through hole.
Figure 1A:
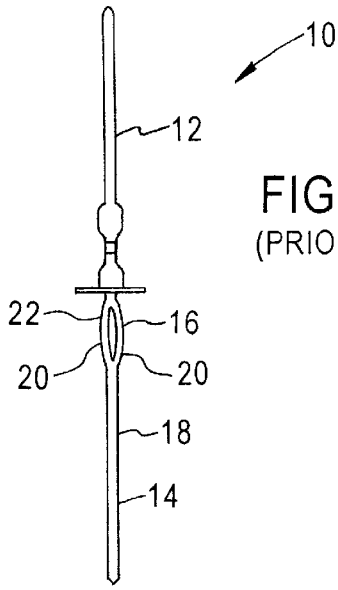
FIG. 1A (PRIOR ART)
FIG. 1A is an illustration of a prior art electrical contact.
Figure 2:
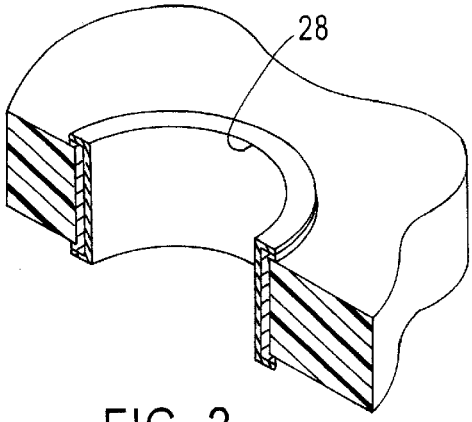
FIG. 2 (PRIOR ART)
FIG. 2 is a partial cross-sectional view of a through hole.
Figure 3:
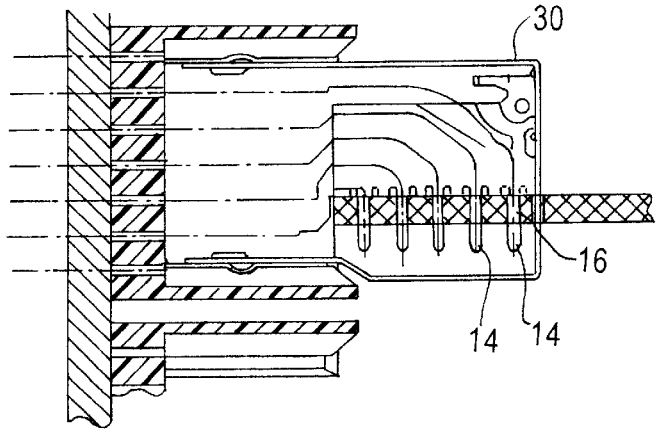
FIG. 3 (PRIOR ART)
FIG. 3 is an illustration of a prior art electrical connector having the prior art electrical contacts illustrated in FIG. 1A.

The electrical contact 200 of the present invention is identical to the contact illustrated in FIG. 1A except for the compliant section 220. As illustrated in FIG. 4A, the compliant section 220 is connected to the elongated section 14. The contact 200 can have any type of primary section 12 as illustrated in FIG. 1A as known to those of skill in the art. Similarly, the elongated section 14 can vary in length. It is customary in various applications to have sequential electrical contact and thus within any given electrical connector it is quite possible to have elongated sections 14 of different lengths. The compliant section 220 has external dimensions identical to the prior art contact 10 illustrated in FIG. 1A. Thus, rounded outer surfaces 16 and 20 have a width, at the widest point, which is larger than the diameter of the plated through hole 28. Of course, the dimensions can vary depending on the size of the plated through hole and the size of the contact. There is a central largest hole 230 which has a centerline coincident with the longitudinal access of the electrical contact and a horizontal center line which should be coincident with the widest portion of compliant section 20. Along the same longitudinal axis are located opposed smaller diameter holes 232 and 234. An hourglass shaped bridge or a first main beam 240 is formed between holes 220 and 232. A second hourglass shaped bridge or second main beam 242 is formed between holes 230 and 242. The rounded outer surfaces 16, 20 are convex relative to the holes 220, 232, 234.

As depicted in FIG. 4B, when the compliant section 220 is inserted into the plated through hole 28, forces P, apply a horizontal force to the compliant section 220 along surfaces 16 and 20, respectively. The forces P tend to elongate the compliant section 220 causing holes 220, 230, 232 to become ovalized as depicted in FIG. 4B. Advantageously, when these holes become ovalized, according to the present invention, the elongated section 14 remains straight. The purpose of the compliant section 220 is to maintain a holding force when inserted into the PC board hole 28. The three holes, 220, 230, 232 and the compliant section 220 allow main beams 240, 242 to have different cross-sectional areas due to any misalignment/centering of the holes 220, 230, 232 during a stamping process. When the contact and the compliant section are pressed into the PC board hole 28, an even force (illustrated by P) is applied to the beams 240, 242 of the compliant section 220. The beams or webs 240, 242 created by the location of holes 220, 230, 232 serves to strengthen the compliant section due to the added compression needed to buckle the beams 240, 242. The two beams 240, 242 also work as tension devices to keep a weaker beam (due to the thinner cross-section of the beam) joined to a stiffer beam. The result is the uniform elongation of the compliant section 220, hence, eliminating any tilting that would have occurred due to the non-linear compression of both compliant beams. It is critical to have the thin webbing to the increasing insertion loads required to compress the compliant section.

Figure 5B:
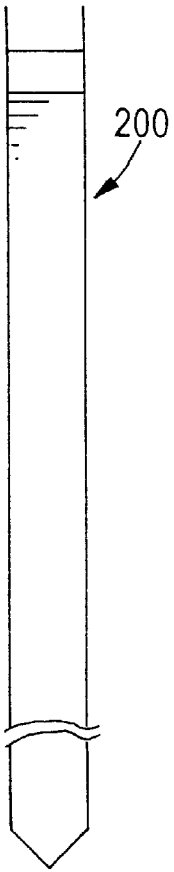
FIG. 5B is a side elevational view of the secondary section according to the present invention.
Figure 5A:
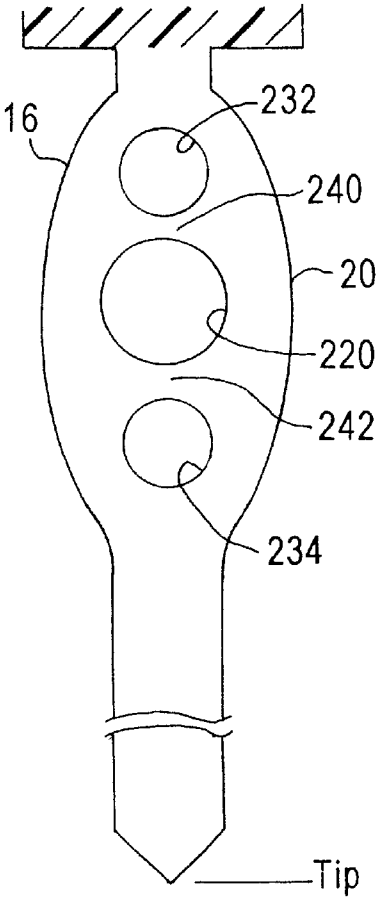
FIG. 5A is an enlarged view illustrating the holes used in the compliant section according to the present invention.

As depicted in FIG. 5A, the central hole 230 has a radius of 0.0008 inches. Holes 230 and 232 each have a radius of 0.007 inches and have a tolerance of 0.0005 inches. The centerlines of holes 230 and 232 are each spaced 0.018 inches from the centerline of hole 220. FIG. 5B illustrates a side view of the contact 200. The contact is preferably stamped from an alloy C5100 phosphorous bronze and is approximately 0.015 inches thick.

It should now be apparent that a compliant section for an electrical contact has been described in which the compliant section can be inserted into a through hole in a PC board and yet the elongated section remains straight.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A contact for insertion into a hole in a PC board, comprising:

a contact body including an engagement portion for engagement with an electrical connector body;

said contact body having an elongated section and a compliant section connecting said engagement portion and said elongated section;

said compliant section having a plurality of holes formed therethrough thereby forming at least one bridge section, each bridge section being located between two adjacent ones of said holes and extending transverse to said elongated section, said plurality of holes being arranged along a centerline, wherein opposed rounded surfaces form a first rounded surface and a second rounded surface which together almost surround. said plurality of holes, wherein a center one of said plurality of holes has a larger diameter than the other of said holes.

2. The contact of claim 1, wherein said plurality of holes comprises three holes joined coaxially along a centerline of said contact body.

3. The contact of claim 1, wherein said other two holes have equal diameters.

4. The contact of claim 1, wherein said center one of said plurality of holes has a radius of 0.008 inches and the other of said two holes each has a radius of 0.007 inches.

5. The contact of claim 1, wherein the hole is a plated through hole.

6. The contact of claim 1, wherein said other two holes are equally spaced from said large hole.

7. The contact of claim 1, wherein each said bridge has an hourglass shape with a thinnest portion being 0.003 inches across.

8. The contact of claim 1, wherein said compliant section has opposed rounded outer surfaces.

9. The contact of claim 8, wherein said compliant section has flat opposed surfaces through which said plurality of holes extend.

10. The contact of claim 1, wherein said plurality of holes comprises three holes joined coaxially along a centerline of said contact body, said compliant section has opposed rounded surfaces symmetric about a center one of said three holes.

11. The contact of claim 1, wherein said rounded outer surfaces are convex relative to said plurality of holes.

12. The contact of claim 1, wherein said plurality of holes are round.

13. The contact of claim 1, wherein a compressing stress is placed on the bridge sections when the compliant section is inserted into the PC board hole.

14. The contact of claim 1, wherein each of said bridge portions extends between opposed elliptical sections.

15. The contact of claim 1, wherein said plurality of holes is three.

16. A contact for insertion into a hole in a PC board, comprising:

a contact body including an engagement portion for engagement with an electrical connector body;

said contact body having an elongated section and a compliant section connecting said engagement portion and said elongated section;

said compliant section having a plurality of holes formed therethrough thereby forming at least one bridge section, each bridge section being located between two adjacent ones of said holes and extending transverse to said elongate section;

wherein said plurality of holes comprises holes joined coaxially along a centerline of said contact body, said compliant section having opposed rounded surfaces symmetric about a center one of said holes, wherein said rounded outer surfaces are convex relative to said plurality of holes, wherein said opposed rounded surfaces form a first rounded surface and a second rounded surface which together almost surround sand plurality of holes, wherein a center one of said plurality of holes has a larger diameter than the other of said holes and said plurality of holes are arranged along a centerline.

17. An electrical connector having a plurality of contacts each for insertion into a corresponding hole in a PC board, comprising:

a connector body and a plurality of contacts, said connector body having a plurality of locations for receiving a corresponding contact;

each contact comprising:

a contact body including an engagement portion for engagement with an electrical connector body;

said contact body having an elongated section and a compliant section connecting said engagement portion and said elongated section;

said compliant section having a plurality of holes formed therethrough thereby forming at least one bridge section, each bridge section being located between two adjacent ones of said holes and extending transverse to said elongated section, wherein opposed rounded surfaces form a first rounded surface and a second rounded surface which together almost surround said plurality of holes, wherein a center one of said plurality of holes has a larger diameter than the other of said holes and said plurality of holes are arranged along a centerline.

18. The contact of claim 16, wherein said pluarlity of holes is three.

19. The electrical connector of claim 17, wherein said plurality of holes is three.

* * * * *